US009416561B2

(12) United States Patent
Field et al.

(10) Patent No.: US 9,416,561 B2
(45) Date of Patent: Aug. 16, 2016

(54) CYLINDER LOCK CONFIGURED TO BE OPERATED BY A FLAT-BLADED KEY

(71) Applicant: MEDECO SECURITY LOCKS, INC., Salem, VA (US)

(72) Inventors: Peter H. Field, Salem, VA (US); Glenn Hartman, Salem, VA (US)

(73) Assignee: ASSA ABLOY HIGH SECURITY GROUP, INC., Salem, VA (US)

( * ) Notice: Subject to any disclaimer, the term of this patent is extended or adjusted under 35 U.S.C. 154(b) by 0 days.

(21) Appl. No.: 14/605,237

(22) Filed: Jan. 26, 2015

(65) Prior Publication Data

US 2015/0211256 A1 Jul. 30, 2015

Related U.S. Application Data

(60) Provisional application No. 61/931,810, filed on Jan. 27, 2014.

(51) Int. Cl.
*E05B 27/10* (2006.01)
*E05B 19/00* (2006.01)
(Continued)

(52) U.S. Cl.
CPC ..... *E05B 19/0064* (2013.01); *E05B 27/0003* (2013.01); *E05B 27/0017* (2013.01); *E05B 27/0039* (2013.01); *E05B 27/0082* (2013.01);
(Continued)

(58) Field of Classification Search
CPC ..... E05B 19/0058; E05B 19/0064; E05B 27/0039; E05B 27/0082; E05B 27/0017; E05B 27/0003; E05B 19/0023; E05B 19/0041; E05B 27/0032; E05B 27/08; E05B 27/086; Y10T 70/7881; Y10T 70/752; Y10T 70/7593; Y10T 70/7605; Y10T 70/761; Y10T 70/7616; Y10T 70/7621
USPC ..... 70/409, 491, 493–496
See application file for complete search history.

(56) References Cited

U.S. PATENT DOCUMENTS

RE31,910 E 6/1985 Oliver
4,932,229 A * 6/1990 Genakis ..... E05B 27/0039 70/378

(Continued)

FOREIGN PATENT DOCUMENTS

EP 2360333 A2 8/2011
FR 2237483 A5 2/1975
WO WO 9627724 A1 9/1996

OTHER PUBLICATIONS

International Search Report and Written Opinion in International Patent Application No. PCT/US2015/012849, 17 pages (May 13, 2015).

*Primary Examiner* — Lloyd Gall
(74) *Attorney, Agent, or Firm* — Rothwell, Figg, Ernst & Manbeck PC

(57) ABSTRACT

A cylinder lock with a rotating tumbler pin, a sidebar, and a slider has a keyway with a ward projection into the center of the bitting area of a key blade received by the keyway. The tip of each rotating tumbler pin seats on the bitting surfaces remaining to the sides of this center ward of the key, and the tumbler pins that are engaged by the bitting on the side of the key blade do not seat on more than half of the width of the blade. Half the pin width is removed from each tumbler pin near the tip thereof. The key has a bitted section at which one or more bittings are formed and a non-bitted section bitting that is devoid of bitting. The bittings extend at a constant depth to an edge of the key blade.

10 Claims, 19 Drawing Sheets

(51) Int. Cl.
*E05B 27/00* (2006.01)
*E05B 27/08* (2006.01)

(52) U.S. Cl.
CPC ..... *E05B 19/0023* (2013.01); *E05B 19/0041* (2013.01); *E05B 19/0058* (2013.01); *E05B 27/08* (2013.01); *Y10T 70/752* (2015.04); *Y10T 70/7593* (2015.04); *Y10T 70/761* (2015.04); *Y10T 70/7616* (2015.04); *Y10T 70/7621* (2015.04); *Y10T 70/7881* (2015.04)

(56) References Cited

U.S. PATENT DOCUMENTS 5,375,444 A * 12/1994 Smith ..... E05B 27/0053 70/337
5,419,168 A * 5/1995 Field ..... E05B 27/0039 70/378
5,615,565 A 4/1997 Field
5,682,779 A 11/1997 Dolev
6,023,954 A 2/2000 Field
6,058,750 A 5/2000 Li
6,076,386 A * 6/2000 Etchells ..... E05B 9/086 70/358
6,257,033 B1 7/2001 Ziv-Av
6,477,875 B2 * 11/2002 Field ..... E05B 27/0032 70/491
6,490,898 B1 12/2002 Mottura
6,945,082 B2 * 9/2005 Field ..... E05B 19/0017 70/409
7,007,528 B2 * 3/2006 Chong ..... E05B 29/004 70/383
7,681,425 B2 * 3/2010 Teixeira ..... E05B 17/16 70/367
7,775,074 B1 * 8/2010 Tobias ..... E05B 27/0017 70/419
7,797,973 B2 9/2010 Field et al.
8,186,194 B2 * 5/2012 Field ..... E05B 27/0035 70/409
8,479,545 B2 * 7/2013 Teixeira ..... E05B 17/16 70/367
8,720,241 B1 * 5/2014 Widen ..... E05B 27/00 70/409
2005/0061043 A1 * 3/2005 Widen ..... E05B 27/0039 70/494
2010/0199731 A1 8/2010 Kofman
2015/0096342 A1 * 4/2015 Field ..... E05B 19/00 70/344
2015/0114059 A1 * 4/2015 Hiscocks ..... E05B 27/0003 70/352

* cited by examiner

CYLINDER LOCK CONFIGURED TO BE OPERATED BY A FLAT-BLADED KEY

CROSS REFERENCE OF RELATED APPLICATION

This application claims the benefit under 35 U.S.C. §119 (e) of the filing date of provisional patent application Ser. No. 61/931,810 filed Jan. 27, 2014, the disclosure of which is incorporated herein by reference.

FIELD OF THE DISCLOSURE

The field of this disclosure relates to a flat-bladed key and associated cylinder lock. In one embodiment, the key and lock are interoperable in either of two, 180-degree spaced apart orientations of the key.

BACKGROUND

There is a market need for a reversible key for horizontal keyway cylinder locks. A reversible key is bitted on both sides of the key blade and is thus easier to align and insert into the keyway, as it works either way it is inserted. A further use for a key that is bitted on both sides of the key blade is to operate two different cylinder locks. For example, a key blade can be bitted on one side to operate a vestibule cylinder lock when the key is inserted one way and can be differently bitted on the opposite side to operate an apartment door cylinder lock when the key is inserted the other way.

To implement a reversible key it is necessary to design a cylinder lock in which the tumbler pins that are engaged by the bitting on the side of the key blade do not seat on more than half of the width of the blade, and the bitting area on the blade must occupy no more than one-half of the width of the side of the blade. In addition, there must be sufficient strength in the center of the blade to keep the blade from breaking under the stress of applying torque to the cylinder lock. Retaining sufficient strength can be challenging if both sides of the key blade are bitted to operate a lock, as bitting the opposed sides of the lock results in a significant removal of material from the thickness of the key blade. The keys of existing horizontal cam locks have bittings that extend across almost the full width of the key blade, often leaving the key blade too weak for some applications.

Additionally, a cylinder keyway with a ward projection into the center of the bitting area of the key blade has never been employed in a cylinder having a rotating tumbler pin—sidebar cylinder. That is, there is no warding on the key blade or keyway in the portion of the key blade at which the bitting is formed. The tip of each rotating tumbler pin seats on the bitting surfaces remaining to the sides of this center ward.

SUMMARY

The following presents a simplified summary in order to provide a basic understanding of some aspects described herein. This summary is not an extensive overview of the claimed subject matter. It is intended to neither identify key or critical elements of the claimed subject matter nor delineate the scope thereof. Its sole purpose is to present some concepts in a simplified form as a prelude to the more detailed description that is presented later.

In accordance with aspects of the disclosed subject matter, skew cut bittings are specially designed to extend through an edge of the blade, so that the tumbler pins can seat at the correct location on the blade of the key. The rotating and elevating tumbler pins are larger in diameter than conventional tumbler pins, so the diameter of the tumbler pin extends to the edge of the key blade.

Each tumbler pin is cut in half width-wise near the tip of the pin so that the pin will seat on a bitting that does not extend to the center of the key blade side. This results in a key blade that is stronger than previous horizontal key blades, even if the key blade is bitted on both sides, since only half of each side will be bitted.

According to other aspects, the key may include bittings on one or both sides of the blade.

According to other aspects, the key for the horizontal keyway cylinder includes a slider bitting at the edge of the horizontal key blade that is configured to engage a slider to move the slider from a sidebar blocking position to a non-blocking position.

Aspects of the disclosure are embodied in a key comprising a blade having a first side and an opposed second side, the first and second sides extending between opposed edges of the blade and defining a width of the blade. The width of at least one of the first and second sides is divided into a bitted section having bitting formed thereon—the bitting being configured to engage one or more tumbler pins of a cylinder lock to elevate and/or rotate each tumbler pin—and a non-bitted section that is devoid of any bitting formed thereon. Each of the bittings in the bitted section of the blade extend at a constant depth through one edge of the blade. The key further includes warding features formed on the at least one side for cooperating with corresponding warding features of a keyway configured to receive the key, and the warding features are provided on both the bitted section and the non-bitted section.

According to other aspects, the key may further comprise a slider bitting formed on at least one of the opposed edges of the blade and configured to contact a slider within a cylinder lock and to move the slider from a first position to a second position as the blade is advanced into a keyway of the lock.

According to other aspects, the key may further comprise a slider bitting located on each of the opposed edges of the blade, and the slider bitting on each edge is configured to contact the slider at the same prescribed longitudinal distance along the blade.

According to other aspects, the key may further comprise a slider bitting located on each of the opposed edges of the blade, and the slider bitting on one edge is configured to contact the slider at a first prescribed longitudinal distance along the blade, and the slider bitting on the opposite edge is configured to contact the slider at a second prescribed longitudinal distance along the blade that is different from the first longitudinal distance.

According to other aspects, the bitted section and the non-bitted section may each comprise one half the width of the blade.

According to other aspects, the first side and the second side of the blade may comprise a bitted section and a non-bitted section.

According to other aspects, the bitted section on the first side may be opposite the non-bitted section on the second side, and the non-bitted section on the first side may be opposite the bitted section on the second side.

According to other aspects, the key may further comprise a first distal end bevel at a distal end of a portion of the blade corresponding to a bitted section of one side of the blade and a second distal end bevel at a distal end portion of the blade corresponding to a non-bitted section of the one side of the blade. The first distal end bevel and the second distal end bevel are beveled at opposite angles.

According to other aspects, at least one bitting may comprise straight, angled sides and a curved portion.

According to other aspects, the warding features may comprise one or more warding grooves extending through the bitting in the bitted section.

According to other aspects, two or more bittings may be formed at different depths into the blade.

According to other aspects, at least one bitting may be formed at an angle relative to a line that is perpendicular to a longitudinal dimension of the blade.

According to other aspects, the key may further comprise a bow, wherein the blade extends from the bow.

Aspects of the disclosure are also embodied in a key comprising a blade having a first side and an opposed second side, the first and second sides extending between opposed first and second edges of the blade, bitting formed on at least one of the first and second sides and configured to engage one or more tumbler pins of a cylinder lock to elevate and/or rotate each tumbler pin, and slider bitting formed on at least one of the first and second edges of the blade and configured to contact a slider within a cylinder lock and to move the slider from a first position to a second position as the blade is advanced into a keyway of the lock.

According to other aspects, a slider bitting may be located on each of the first and second edges of the blade, and the slider bitting on each edge is configured to contact the slider at the same prescribed longitudinal distance along the blade.

According to other aspects, a slider bitting may be located on each of the first and second edges of the blade, and the slider bitting on the first edge is configured to contact the slider at a first prescribed longitudinal distance along the blade, and the slider bitting on the second edge is configured to contact the slider at a second prescribed longitudinal distance along the blade that is different from the first longitudinal distance.

According to other aspects, bitting may be formed on the first side and the second side of the blade.

According to other aspects, each of the bittings may extend at a constant depth through one edge of the blade.

According to other aspects, the key may further comprise a first distal end bevel at a distal end of a first portion of the blade and a second distal end bevel at a distal end of a second portion of the blade. The first distal end bevel and the second distal end bevel are beveled at opposite angles.

According to other aspects, at least one bitting may comprises straight, angled sides and a curved portion.

According to other aspects, the key may further comprise warding features formed on the at least one side for cooperating with corresponding warding features of a keyway configured to receive the key.

According to other aspects, the warding features may comprise one or more warding grooves extending through the bitting.

According to other aspects, two or more bittings may be formed at different depths into the blade.

According to other aspects, at least one bitting may be formed at an angle relative to a line that is perpendicular to a longitudinal dimension of the blade.

According to other aspects, the key may further comprise a bow, wherein the blade extends from the bow.

Aspects of the disclosure are also embodied in a lock comprising a cylinder having a keyway and one or more tumbler holes formed therein and extending to the keyway, one or more tumbler pins, each disposed in a corresponding one of the tumbler holes, and a sidebar disposed in a sidebar cavity formed in the cylinder and moveable within the sidebar cavity between a first position and a second position. In the first position, the sidebar extends outwardly from the sidebar cavity to engage a sidebar groove formed in a housing within which the plug is rotationally disposed so as to prevent the plug from rotating with respect to the housing, and in the second position, the sidebar is retracted into the sidebar cavity to disengage from the sidebar groove and permit the plug to rotate with respect to the housing. Each tumbler pin is configured to be moveable between a first position blocking movement of the sidebar from its first position to its second position and a second position permitting movement of the sidebar from its first position to its second position. The lock further includes a slider disposed in a slider cavity formed in the cylinder and moveable within the slider cavity between a first position and a second position. In the first position, the slider blocks movement of the sidebar from its first position to its second position, and in the second position, the slider does not block movement of the sidebar from its first position to its second position. The keyway is configured and oriented with respect to the tumbler pins and corresponding tumbler holes so that the width of the keyway is generally perpendicular to the axes of the tumbler holes so that a key having bitting formed on a side thereof will engage tumbler pins positioned within the tumbler holes to move each tumbler pin from its first position to its second position. A portion of the slider extends into the keyway so as to be engaged by a key inserted into the keyway to move the slider from its first position to its second position.

Aspects of the disclosure are also embodied in a lock comprising a cylinder having a keyway and one or more tumbler holes formed therein and extending to the keyway, one or more tumbler pins, each disposed in a corresponding one of the tumbler holes, and a sidebar disposed in a sidebar cavity formed in the cylinder and moveable within the sidebar cavity between a first position and a second position. In the first position, the sidebar extends outwardly from the sidebar cavity to engage a sidebar groove formed in a housing within which the plug is rotationally disposed so as to prevent the plug from rotating with respect to the housing, and in the second position, the sidebar is retracted into the sidebar cavity to disengage from the sidebar groove and permit the plug to rotate with respect to the housing. Each tumbler pin is configured to be moveable between a first position blocking movement of the sidebar from its first position to its second position and a second position permitting movement of the sidebar from its first position to its second position. The keyway is configured and oriented with respect to the tumbler pins and corresponding tumbler holes so that the width of the keyway is generally perpendicular to the axes of the tumbler holes so that a key having bitting formed on a side thereof will engage tumbler pins positioned within the tumbler holes to move each tumbler pin from its first position to its second position. A portion of the width of each tumbler pin is removed near a tip thereof so that the tip of the tumbler pin engages only a portion of the width of the key blade.

According to other aspects, the lock may further comprise an axial channel extending along each tumbler hole and a lug extending from each tumbler pin and being disposed in the axial channel of the corresponding tumbler hole. The width of the axial channel is larger than the width of the lug, so that the pin may rotate partially about its longitudinal axis within the tumbler hole until the lug contacts a side of the axial channel.

According to other aspects, the sidebar may include sidebar pins aligned with sidebar pin holes extending through a wall forming an end of the sidebar cavity and into a corresponding one of the tumbler holes. Each tumbler pin includes a sidebar hole formed therein. When each tumbler pin is in its first position, the sidebar hole formed in the tumbler pin is not aligned with the sidebar pin hole so that a corresponding sidebar pin extending through the sidebar pin hole contacts the tumbler pin to block the sidebar from moving from its first position to its second position. When each tumbler pin is in its second position, the sidebar hole formed in the tumbler pin is aligned with the sidebar pin hole so that the corresponding sidebar pin extending through the sidebar pin hole extends into the sidebar hole of the tumbler pin to allow the sidebar to move from its first position to its second position.

According to other aspects, the sidebar may include slider slots formed therein. The slider includes sidebar lugs extending into the sidebar cavity. When the slider is in its first position, the sidebar lugs are not aligned with the slider slots so that the sidebar contacts the sidebar lugs to block the sidebar from moving from its first position to its second position. When the slider is in its second position, the sidebar lugs are aligned with the slider slots to allow the sidebar to move from its first position to its second position.

According to other aspects, the tumbler pin may include a chiseled end configured to be engaged by the key to elevate the tumbler pin from its first position to its second position.

According to other aspects, the tumbler pin may include a chiseled end configured to be engaged by the key to elevate and rotate the tumbler pin from its first position to its second position.

According to other aspects, each tumbler pin may include a cut-out at a key-engaging portion of the tumbler pin so that the tumbler pin engages only a portion of the key.

According to other aspects, the slider may further include a key contact lug extending into the keyway and configured to be engaged by a portion of the key inserted into the keyway to move the slider.

According to other aspects, the slider cavity may extend into the cylinder at an orientation that is generally perpendicular to the orientation of the sidebar cavity.

According to other aspects, the keyway includes a warding ridge that is aligned with the one or more tumbler holes.

Other features and characteristics of the disclosure, as well as the methods of operation, functions of related elements of structure and the combination of parts will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

The accompanying drawings, which are incorporated herein and form part of the specification, illustrate various, non-limiting embodiments. In the drawings, common reference numbers indicate identical or functionally similar elements.

DETAILED DESCRIPTION

Figure 1:
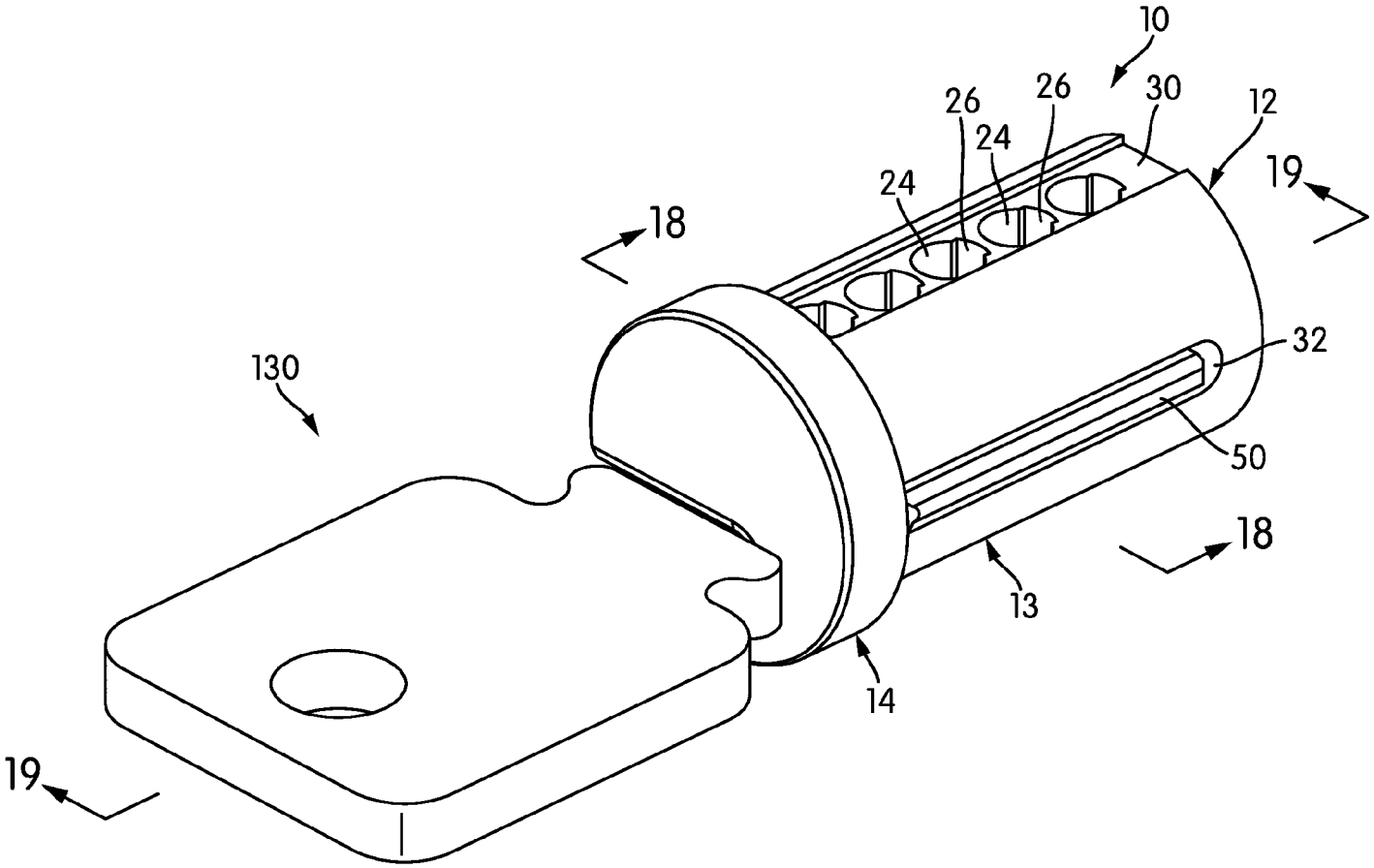
FIG. 1 is a perspective view of a key and cylinder lock assembly embodying aspects of the disclosed subject matter.

Unless defined otherwise, all terms of art, notations and other technical terms or terminology used herein have the same meaning as is commonly understood by one of ordinary skill in the art to which this disclosure belongs. All patents, applications, published applications and other publications referred to herein are incorporated by reference in their entirety. If a definition set forth in this section is contrary to or otherwise inconsistent with a definition set forth in the patents, applications, published applications, and other publications that are herein incorporated by reference, the definition set forth in this section prevails over the definition that is incorporated herein by reference.

Unless otherwise indicated or the context suggests otherwise, as used herein, "a" or "an" means "at least one" or "one or more."

This description may use relative spatial and/or orientation terms in describing the position and/or orientation of a component, apparatus, location, feature, or a portion thereof. Unless specifically stated, or otherwise dictated by the context of the description, such terms, including, without limitation, top, bottom, above, below, under, on top of, upper, lower, left of, right of, in front of, behind, next to, adjacent, between, horizontal, vertical, diagonal, longitudinal, transverse, etc., are used for convenience in referring to such component, apparatus, location, feature, or a portion thereof in the drawings and are not intended to be limiting.

Furthermore, unless otherwise stated, any specific dimensions mentioned in this description are merely representative of an exemplary implementation of the disclosed subject matter and are not intended to be limiting.

Figure 2:
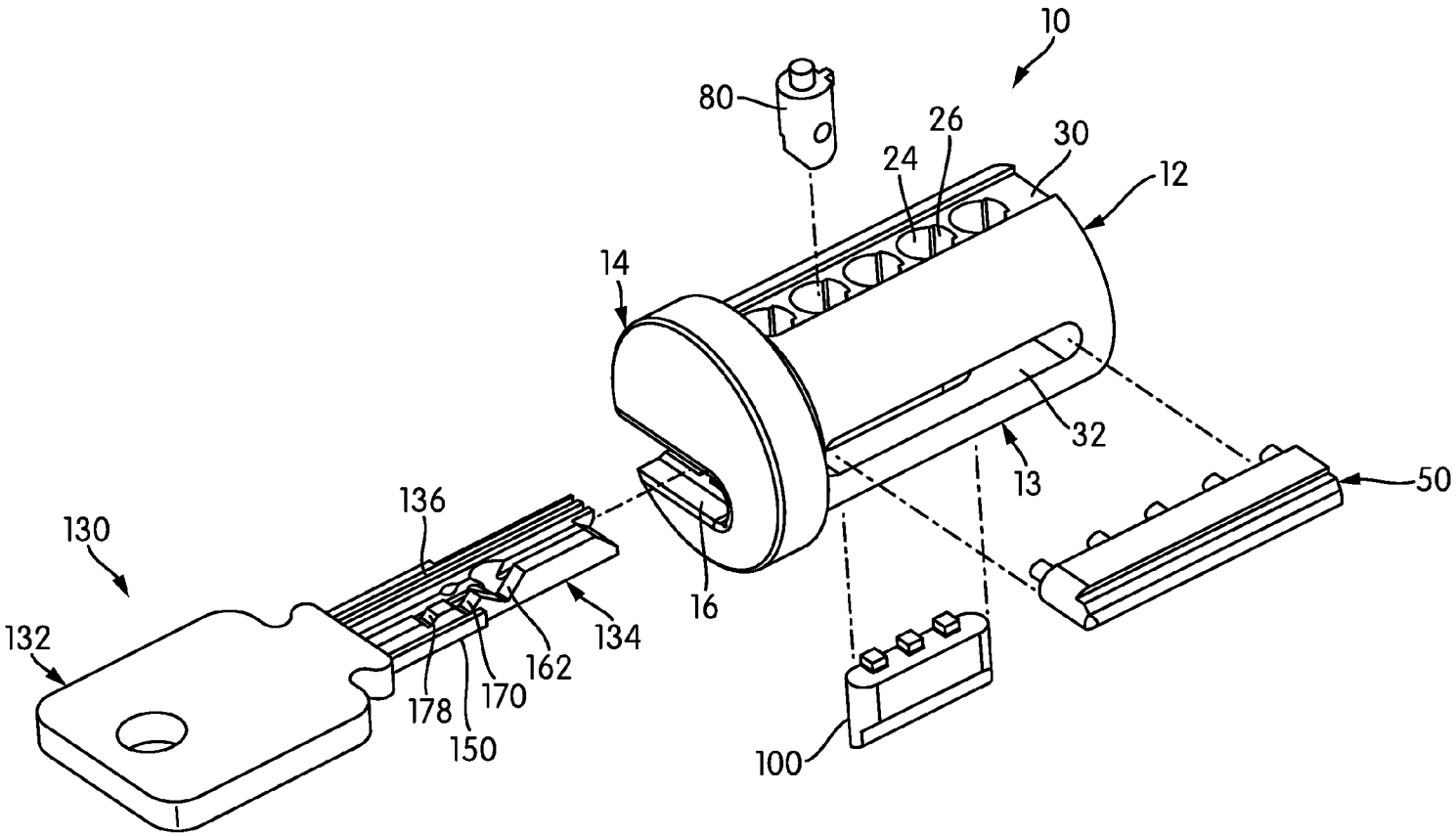
FIG. 2 is an exploded, perspective view of the key and cylinder lock.

A lock and key assembly comprising a cylinder lock 10 and a cooperating flat key 130 is shown in FIGS. 1 and 2. The lock 10 comprises a cylinder, or plug, 12 having a cylindrical portion 13 and a head portion 14. The lock 10 includes tumbler pins 80 oriented radially with respect to the cylindrical portion 13 of the cylinder 12. In one embodiment, the lock includes a plurality of tumbler pins (e.g., five) arranged in an axial alignment. Each tumbler pin 80 is disposed within a corresponding tumbler pin hole 24. Each tumbler pin 80 extends through its associated tumbler pin hole 24 into the keyway 16 of the cylinder 12, where the pins are contacted by and positioned by one or more bittings 162, 170, 178 formed on a side 136 of the blade 134 of the key 130. Lock 10 further includes a sidebar 50 positioned within a sidebar cavity 32 extending longitudinally along a side of the cylinder 12 and oriented in a radial configuration with respect to the cylinder. A slider 100 is disposed within a slider cavity (not shown in FIG. 1 or 2).

Operation of the lock 10 and key 130, including the tumbler pins 80, sidebar 50, and slider 100, will be described in further detail below.

Further details of the cylinder 12 are shown in FIGS. 3-6.

In one embodiment, the cylinder, or plug, 12 includes a cylindrical portion 13 and a circular head 14 having a larger diameter than the cylindrical portion 13. The plug 12, and especially the cylindrical portion 13 thereof, is configured to be rotatable within a bore 202 formed in a housing 200 (See FIG. 21). A keyway 16 extends longitudinally through the plug 12 from the head 14 to a distal end of the cylindrical portion 13. Keyway 16 has a closed edge 18 and an open edge 20 that is open to the outer periphery of the cylindrical portion 13 and the head 14. In the illustrated embodiment, the keyway is located at an off-center position with respect to the plug 12. Keyway 16 further includes warding ridges 22, 25 and corresponding grooves on one or both sides of the keyway 16 and a rectangular feature 23 at the closed end 18 of the keyway 16.

Cylinder 12 includes a groove 30 extending longitudinally along a surface of the cylindrical portion 13 and in which the tumbler pin holes 24 are positioned. Groove 30 receives a retainer strip 96 (See FIG. 21) that retains the spring-biased tumbler pins 80 within the tumbler pin holes 24. Each tumbler pin hole 24 includes an axially-extending channel 26 extending along one side of the hole 24.

Figure 3:
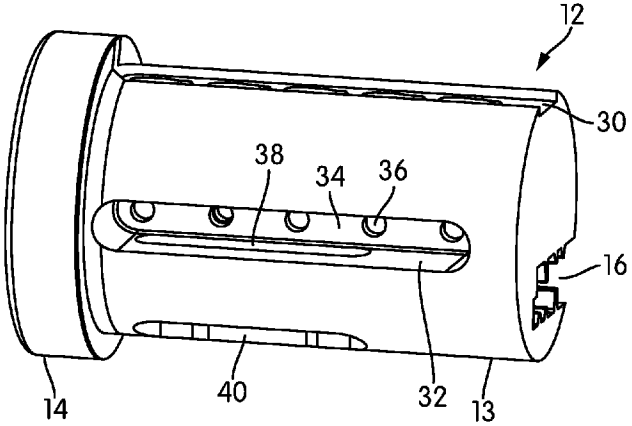
FIG. 3 is a perspective view of a cylinder, or plug, of the cylinder lock.
Figure 20:
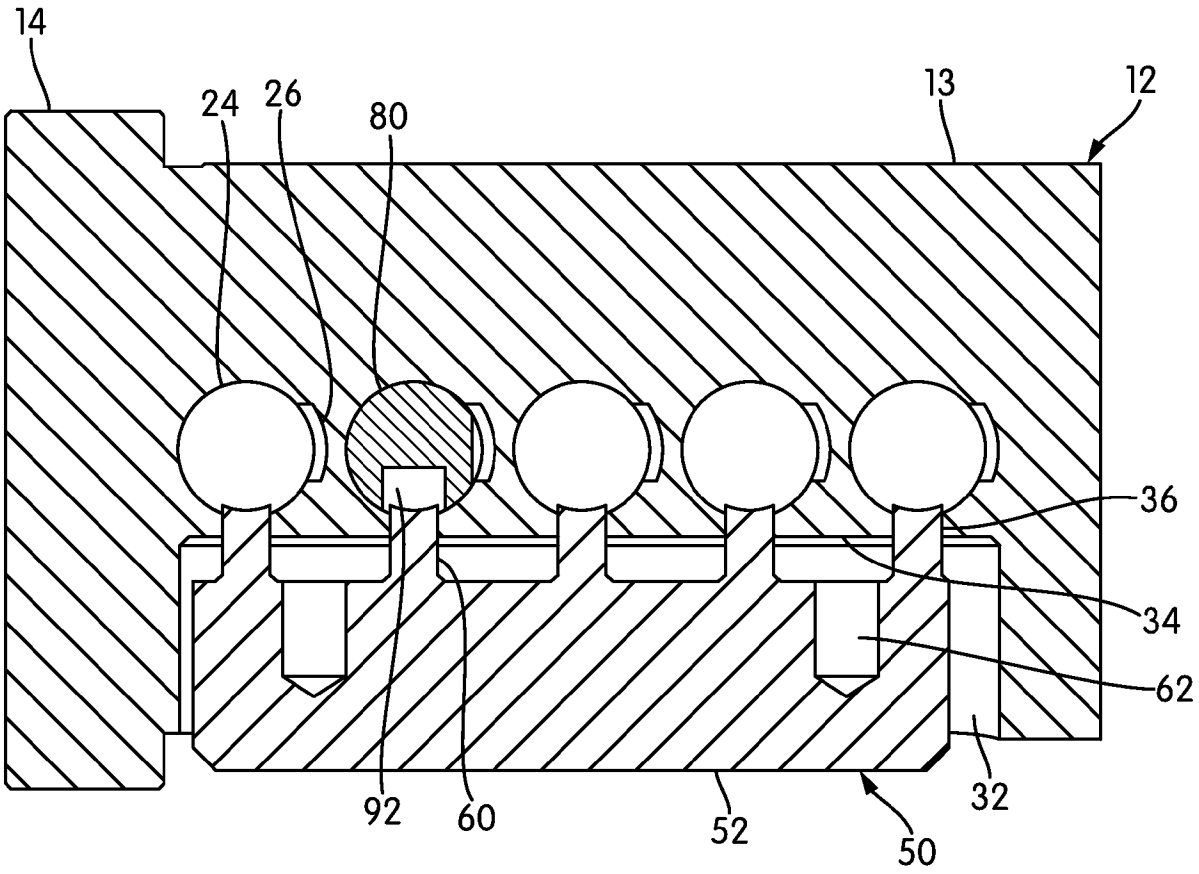
FIG. 20 is a longitudinal cross-section of the cylinder and a sidebar along the line 20-20 in FIG. 6.

As shown in FIG. 3, the sidebar cavity 32 extends longitudinally of the cylinder 12 and has a radial orientation. The cavity 32 has a substantially closed inner end 34 with a plurality of sidebar pin holes 36, each extending from the sidebar cavity 32 into a corresponding one of the tumbler holes 24. See also FIG. 20.

Figure 4:
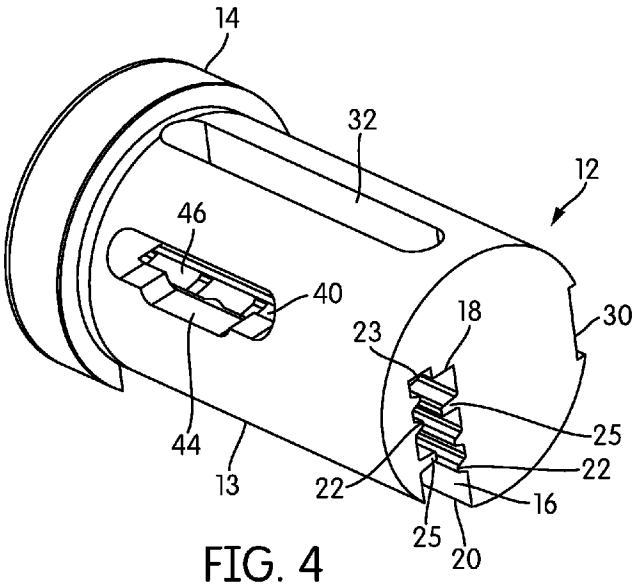
FIG. 4 is perspective view of the cylinder rotated approximately 90 degrees about its longitudinal axis with respect to the view shown in FIG. 3.

As shown in FIG. 4, a slider cavity 40 extends into the cylinder 12 at an orientation that is generally perpendicular to the orientation of the sidebar cavity 32. Slider cavity 40 includes a cutout section 44 and a keyway opening 46 by which the slider cavity 40 is open to the keyway 16 so that a key inserted into the keyway 16 will contact a slider disposed within the cavity 40. Slider cavity 40 extends into the sidebar cavity 32 at a slider entrance 38, as shown in FIG. 3.

Details of the sidebar 50 are shown in FIGS. 7-10.

The sidebar 50 includes a main body portion 54 having a width generally corresponding to (i.e., somewhat smaller than) the width of the sidebar cavity 32 in the plug 12. In one embodiment, the main body portion 54 includes a rounded end 66 having a circular configuration with a diameter corresponding to the width of the main body 54 and a flat end 68 that is generally perpendicular to the longitudinal dimension of the main body 54. The end 68 is cut off to provide clearance for the tip of a screw that holds a tailpiece to the body of the cylinder 12 in some applications or to provide clearance for a pin that is inserted in the back of the body of the cylinder 12 in other applications.

A number of slider slots 64 are formed in one side of the main body 54 and extend generally perpendicularly to the longitudinal dimension of the main body 54. The illustrated embodiment includes three slider slots 64, although other embodiments may include more or less than three slider slots.

The sidebar 50 further includes a plurality of pins 60 extending from a bottom surface 59 of the main body 54. When the sidebar 50 is disposed in the sidebar cavity 32 of the plug 12, each pin 60 is aligned with a corresponding one of the sidebar pin holes 36. In one embodiment, the number of pins 60 corresponds to the number of tumbler pins and tumbler pin holes 24 formed in the plug 12.

Sidebar 50 further includes a nose 52 extending along the length of a top portion of the main body 54. Nose 52 may have a blunt, pointed configuration as shown. The nose 52 is disposed atop an upper body portion 56 having a width that is narrower than the main body 54, thereby defining longitudinally extending shoulders 58 on either side of the nose 52.

Figure 21:
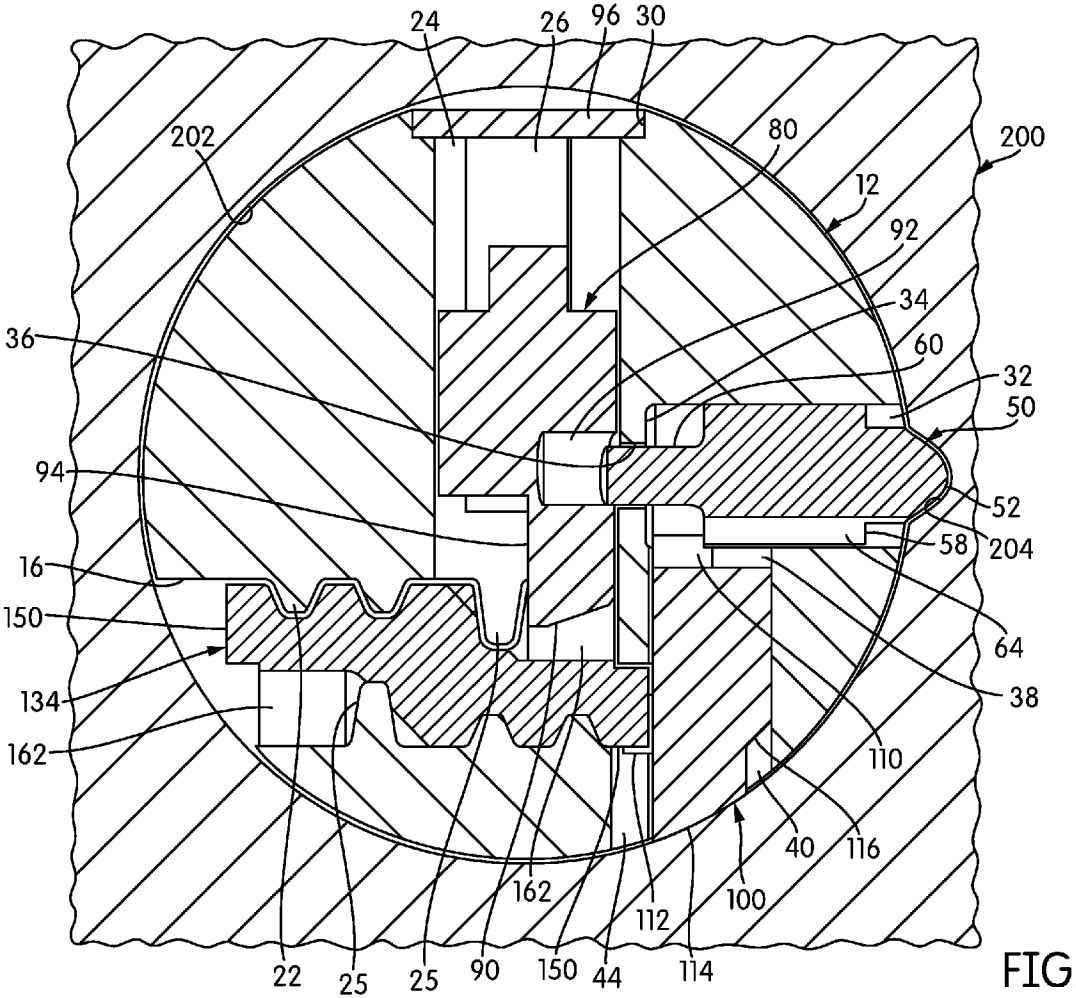
FIG. 21 is an end cross-sectional view of the lock and key assembly along the line 18-18 in FIG. 1 within a housing.
Figure 22:
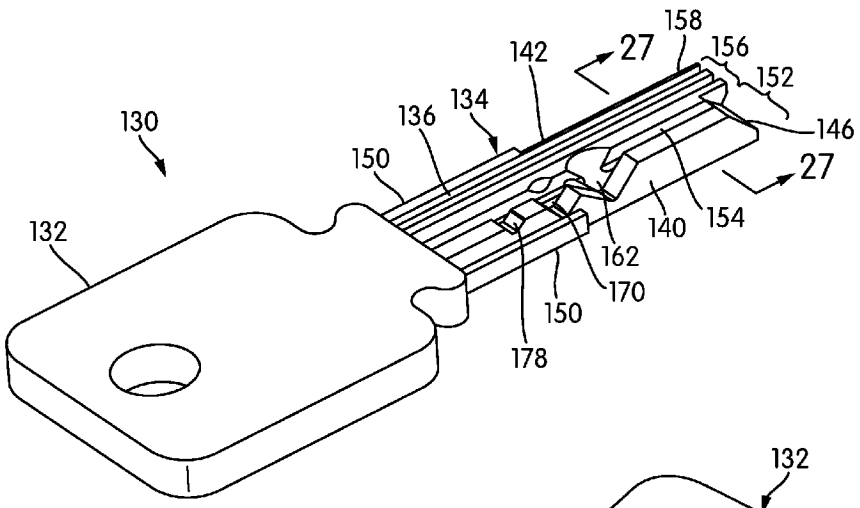
FIG. 22 is a perspective view from a first end of a key embodying aspects of the disclosed subject matter.
Figure 23:
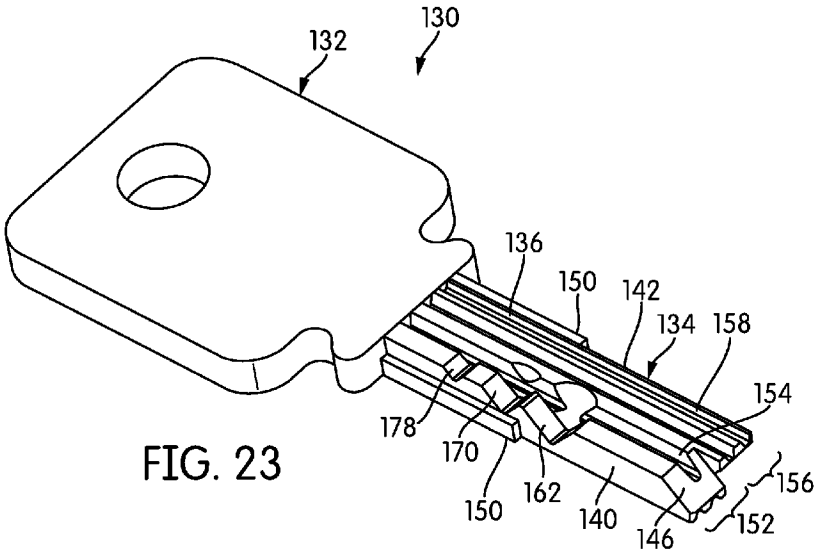
FIG. 23 is a perspective view of the key from a second end of the key.

The sidebar 50 is moveable within the sidebar cavity 32 between a first position and a second position. As shown in FIG. 21, in the first position, the sidebar 50 extends radially outwardly from the cavity 32 so that the nose 52 engages a corresponding longitudinally extending sidebar groove 204 formed in a side surface of the bore 202 of the housing 200 within which the plug 12 is disposed so as to prevent the plug 12 from rotating with respect to the housing. In the second position, the sidebar 50 is radially retracted into the sidebar cavity 32 so that the nose 52 is disengaged from the sidebar groove 204 in the housing 200, thereby permitting the plug 12 to rotate with respect to the housing 200 within the bore 202.

The sidebar 50 is preferably biased into its first position so that the nose 52 engages the sidebar groove 204 of the housing 200 and prevents rotation of the plug 12 with respect to the housing 200. In the illustrated embodiment, the sidebar 50 includes spring recesses 62 formed in the bottom 59 of the main body 54. In an embodiment, each spring recess 62 receives a coil spring (not shown) one end of which bears against the closed back end 34 in the sidebar cavity 32 of the plug 12. The coil springs provide a radially oriented biasing force that biases the sidebar 50 to a radially outwardly extended position. In one embodiment, the edge of cavity 32 is staked over and bumps against shoulders 58, keeping sidebar springs in recesses 62 from pushing the sidebar 50 out of the cavity 32 when plug 12 is not in a housing.

In operation, the sidebar 50, is biased outwardly by springs disposed in the spring recesses 62 into its first position so as to engage the sidebar groove 204 formed in the bore 202 of the housing 200 within which the plug 12 is disposed. With the nose 52 of the sidebar 50 disposed in the sidebar groove, the plug 12 is prevented from rotating within the housing 200. Upon application of a torque to the plug 12, if the sidebar 50 is not blocked (as will be described in further detail below), the sidebar 50 will move radially inwardly within the sidebar cavity 32 against the resistance of the springs toward its second position and thereby move out of the corresponding sidebar groove 204 formed in the bore 202 of the housing 200, thus permitting the plug 12 to rotate within the bore 202.

Figure 12:
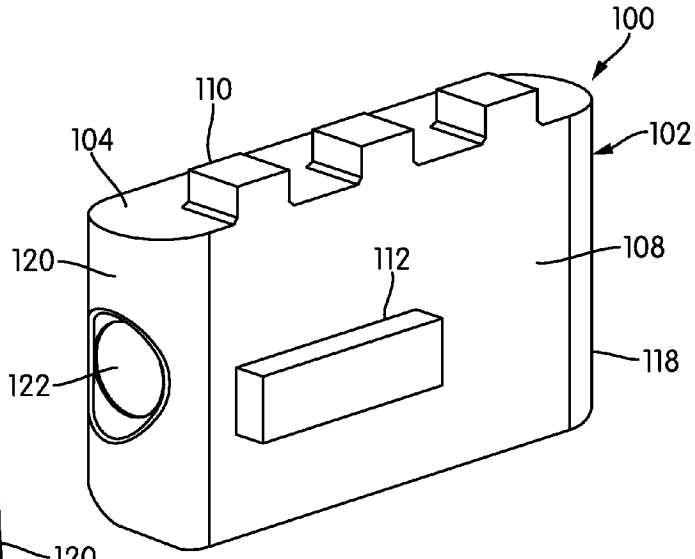
FIG. 12 is a perspective view of the slider showing an inner side of the slider.
Figure 11:
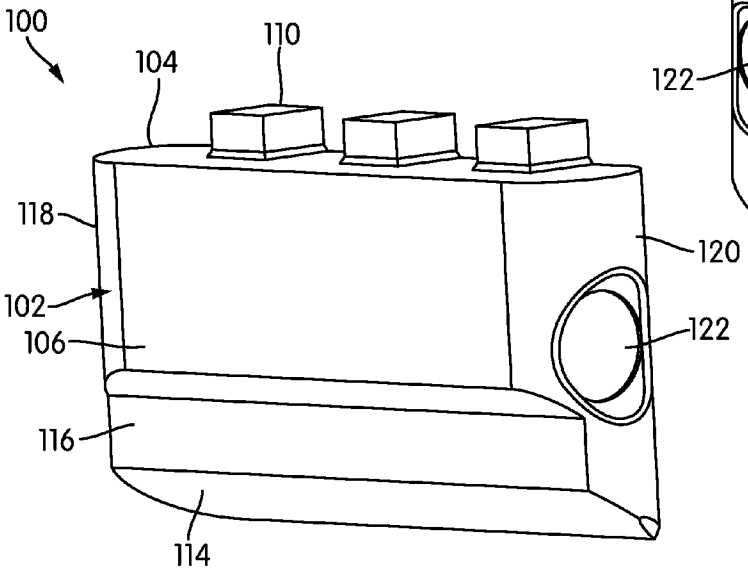
FIG. 11 is a perspective view of a slider of the cylinder lock showing an outer side of the slider.
Figure 13A:
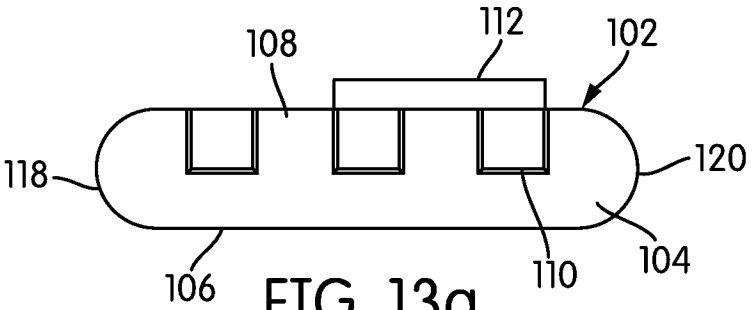
FIGS. 13(*a*), (*b*), (*c*), and (*d*) show a top view, an outer side view, a left end view, and a right end view, respectively, of the slider.
Figure 13B:
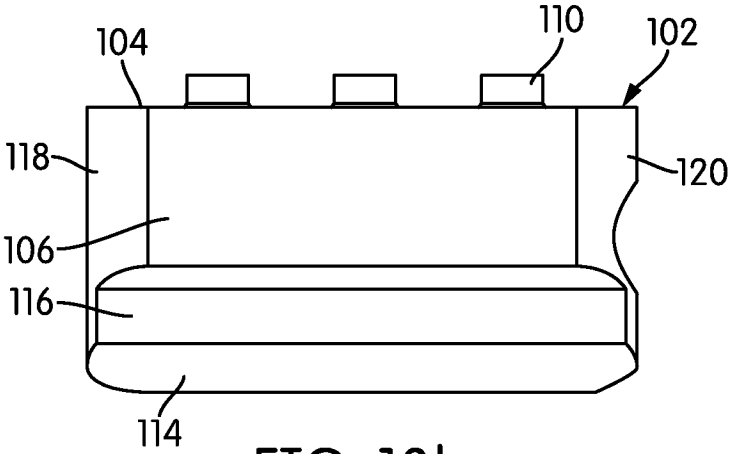
Figure 13C:
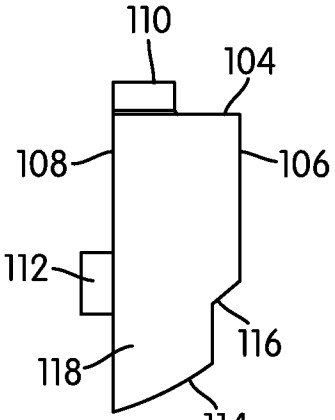
Figure 13D:
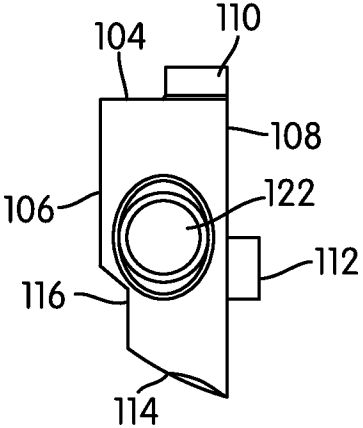
Figure 15:
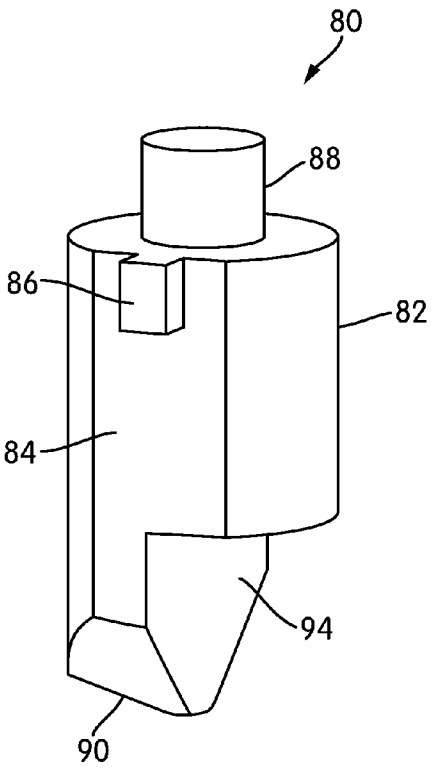
FIG. 15 is a perspective view of the tumbler pin rotated approximately 90 degrees about its longitudinal axis with respect to the view shown in FIG. 14.
Figure 14:
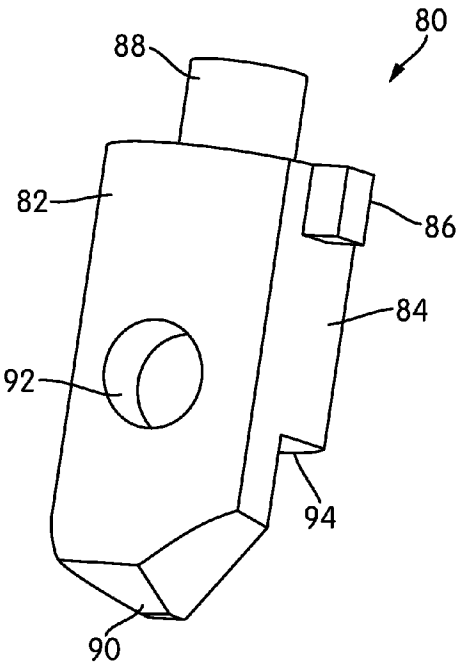
FIG. 14 is a perspective view of a tumbler pin of the cylinder lock.
Figure 17:
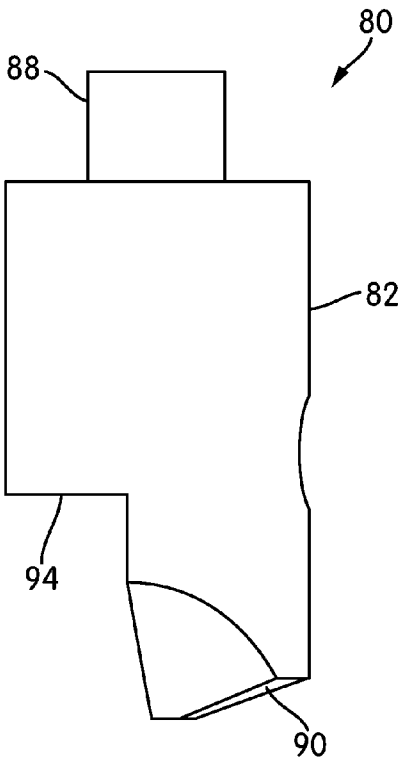
FIG. 17 is a side view of the tumbler pin rotated approximately 90 degrees about its longitudinal axis with respect to the view shown in FIG. 16.
Figure 16:
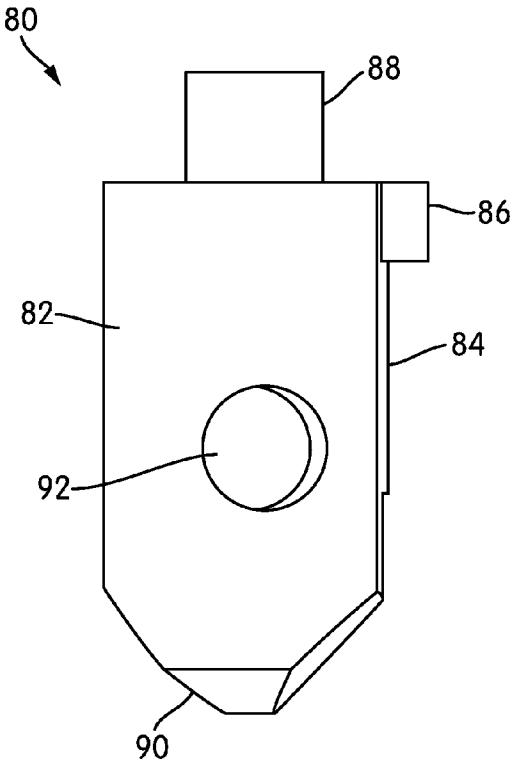
FIG. 16 is a side view of the tumbler pin.
Figure 18:
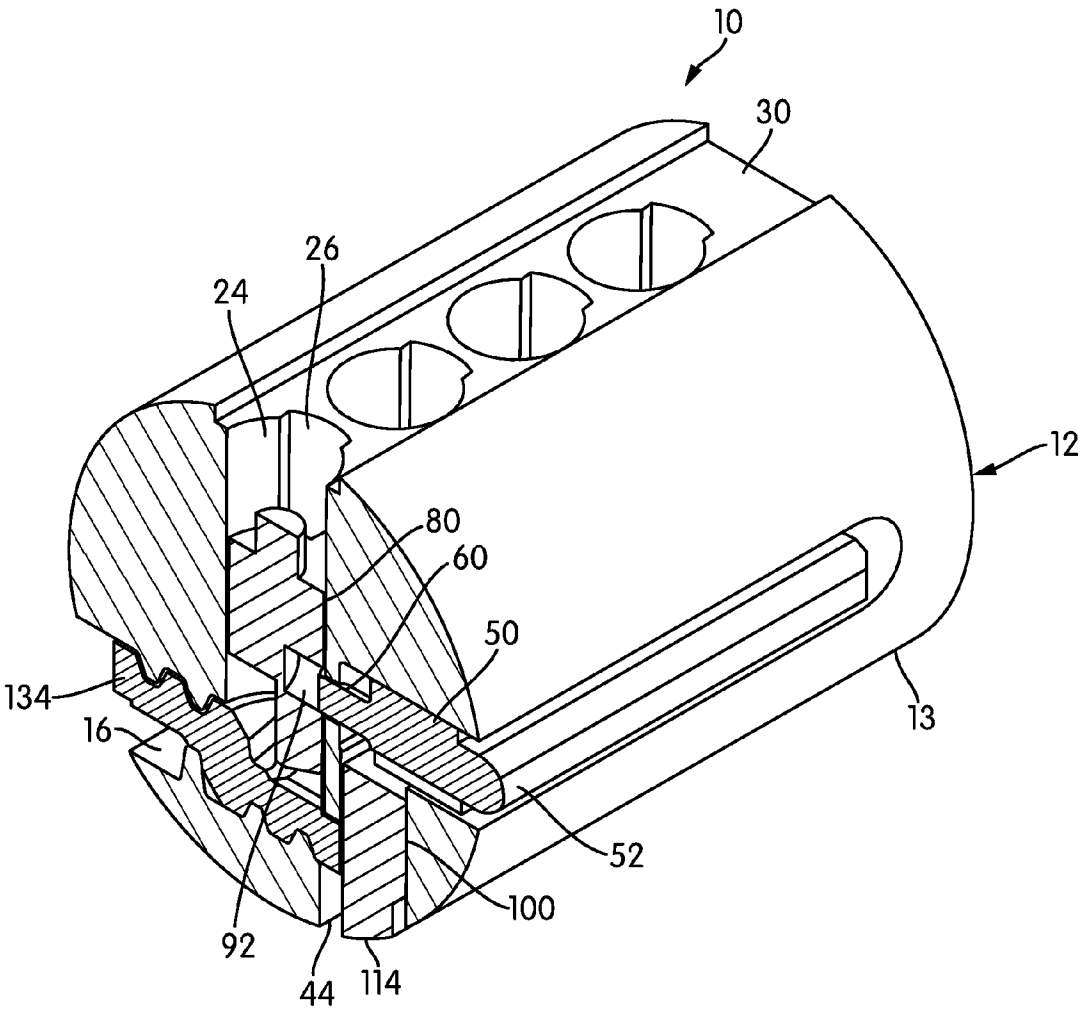
FIG. 18 is perspective, cross-sectional view of the lock and key assembly along the line 18-18 in FIG. 1.
Figure 19:
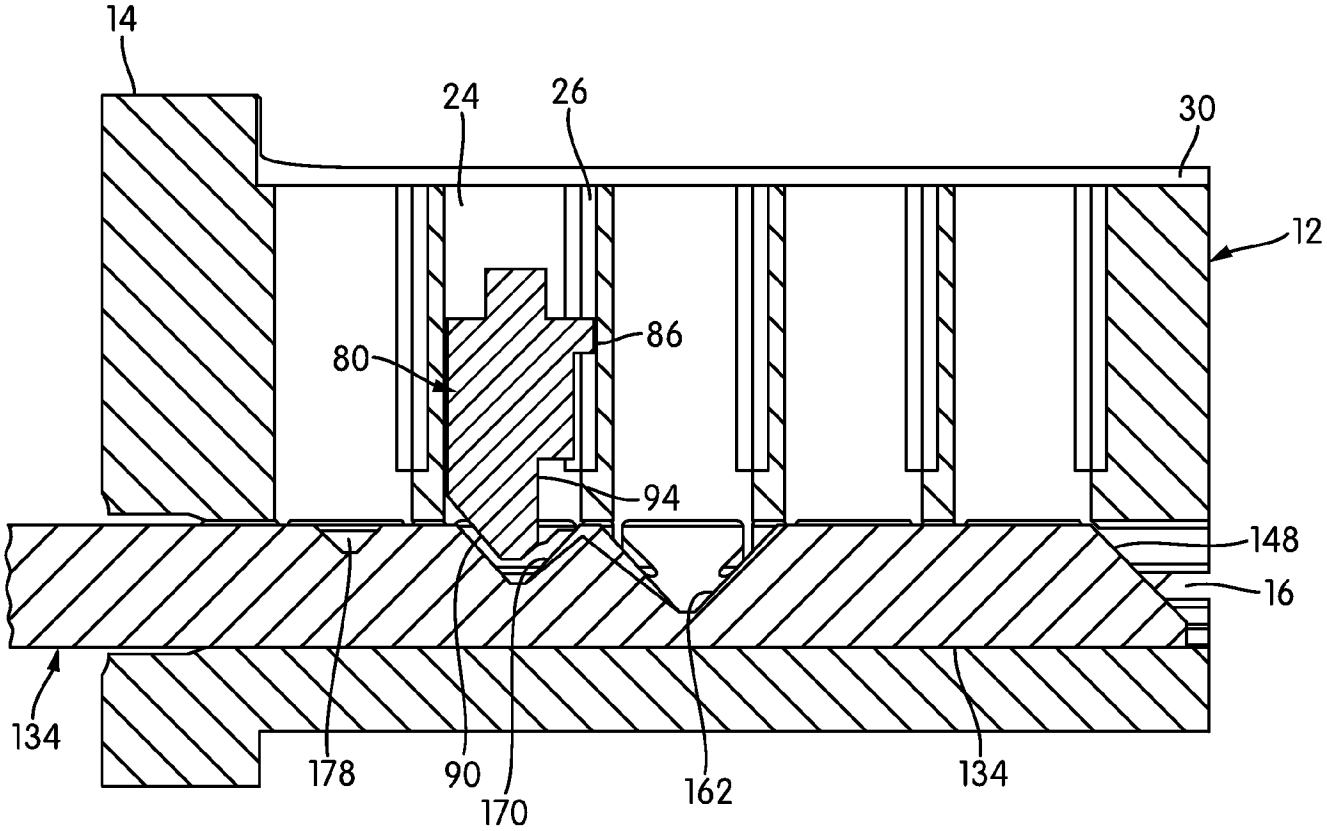
FIG. 19 is a partial, side, cross-sectional view of the lock and key assembly along the line 19-19 in FIG. 1.

Details of the slider 100 are shown in FIGS. 11-13.

Slider 100 includes a body 102 having a top surface 104, a first side 106, and a second side 108 opposite the first side 106. A plurality of sidebar lugs 110 project above the top surface 104. The number of sidebar lugs 110 in one embodiment generally corresponds to the number of slider slots 64 formed in the sidebar 50. The body 102 of the slider 100 includes a first curved end 118 and a second curved end 120. A key contact lug 112 is formed on the second side 108 of the body 102. In one embodiment, the body 102 includes a curved bottom surface 114 and a cutout 116 along a lower portion of the first side 106.

The slider 100 is positioned within the slider cavity 40 and is movable within the slider cavity 40 between a first position and a second position. In the first, or blocking, position, the slider 100 blocks movement of the sidebar 50 from its first position preventing rotation of the plug 12 to its second position, thereby preventing rotation of the plug 12. In the second, or non-blocking, position, the slider is positioned so as to permit movement of the sidebar 50 from its first position to its second position.

The edge of cavity 40 is staked over and bumps against the shoulder of cutout 116 to keep the slider 100 from falling out cavity 40 when plug 12 is not contained in a housing.

The slider 100 is preferably biased into its first, or blocking, position within the slider cavity 40. In one embodiment, an axial spring hole is formed in the second curved end 120 of the body 102. The slider 100 is configured to fit into the slider cavity 40 formed in the plug 12 (See FIG. 4). The cutout 44 in the slider cavity 40 accommodates the key contact lug 112 when the slider is inserted into the cavity 40. The slider is oriented such that the first side 106 faces in a radially outward direction relative to the plug 12, and the second side 108 faces a radially inward direction. The curved bottom 114 of the slider generally conforms to the curvature of the cylindrical portion 13 of the plug 12 so that the bottom surface 114 is generally conforming to the outer periphery of the cylindrical portion 13 and the bore 202 of the housing 200 within which the plug 12 is positioned. A coil spring (not shown) is inserted into the spring hole 122, and an opposite end of the spring bears against one side of the slider cavity 40 so as to bias the slider 100 towards its first position closest to the head 14 of the plug 12. A portion of the key contact lug 12 extends into the keyway 16 via the keyway opening 46 formed within the slider cavity 40, so that the key contact lug 112 is engageable by a key inserted into the keyway 16.

Details of a tumbler pin 80 are shown in FIGS. 14-17.

In one embodiment, the tumbler pin 80 has a cylindrical body 82 with a flattened side 84. A lug 86 is formed on the flattened side 84. A post 88, which is generally coaxial with the cylindrical body 82, projects above the cylindrical body 82. The post 88 is configured to receive an end of a coil spring (not shown), an opposite end of which bears against a retainer strip placed in the top groove 30 so as to bias the tumbler pins radially inwardly into the keyway 16.

The tumbler pin 80 further includes a sidebar hole 92 configured to receive one of the pins 60 of the sidebar 50 extending through a sidebar pin hole 36 into the corresponding tumbler hole 24.

The tumbler pin 80 further includes a chiseled end 90 configured to engage with a corresponding bitting of a key to elevate the tumbler pin 80 and to rotate the pin 80 about its longitudinal axis. In one embodiment, the end 90 has a skew cut configured to provide rotation of the tumbler pin 80 when the end 90 is engaged by a cooperatively skewed bitting of a key.

The tumbler pin 80 further includes a cutout 94 at a lower end. In one embodiment, the amount of material removed by the cutout 94 corresponds to approximately half the width, or diameter, of the cylindrical body 82. Thus, the chiseled end 90 will seat in only part of the bitting formed on the key blade.

The tumbler pin 80 is positioned within a corresponding tumbler hole 24 so that the lug 86 is disposed within the axial channel 26 formed in the tumbler hole 24. The width of the axial channel 26 is larger than the width of the lug 86, thereby permitting rotation of the pin 80 about its longitudinal axis within the tumbler hole 24. The sides of the axial channel 26, however, form hard stops that are contacted by lug 86 to thereby restrict the amount of rotation of the tumbler pin 80 within the tumbler hole 24.

Figure 5:
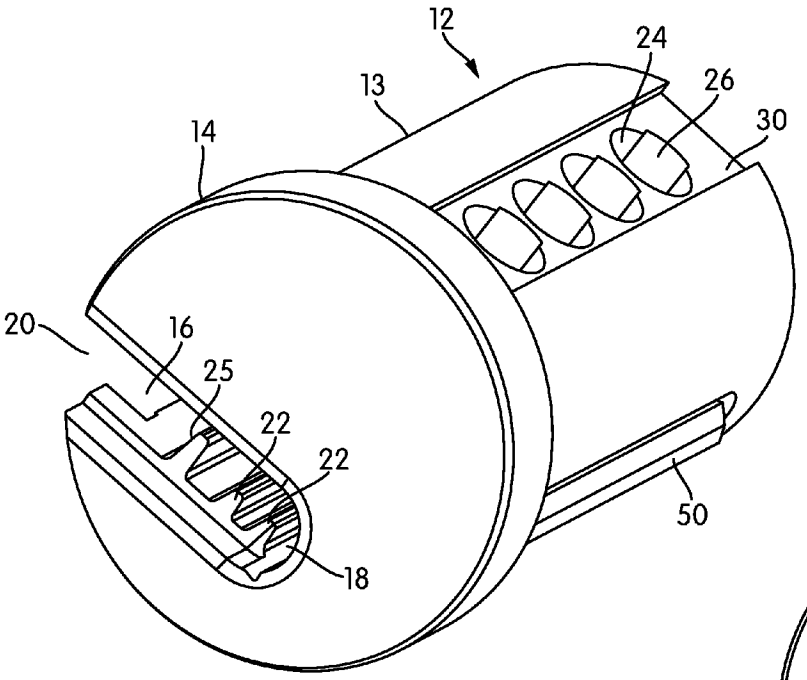
FIG. 5 is a front perspective view of the cylinder.
Figure 6:
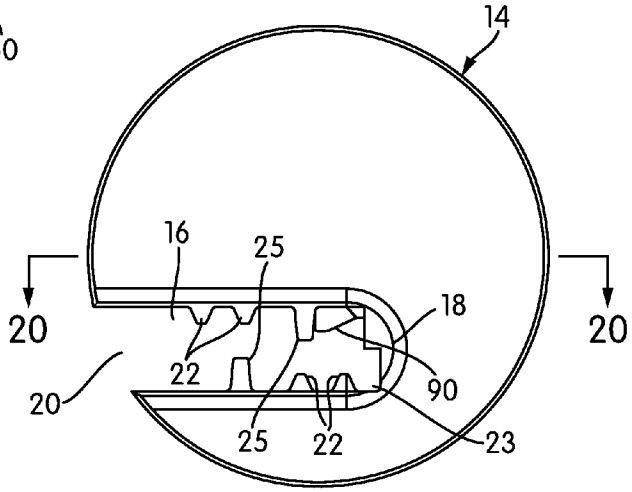
FIG. 6 is a front end view of the cylinder.
Figure 7:
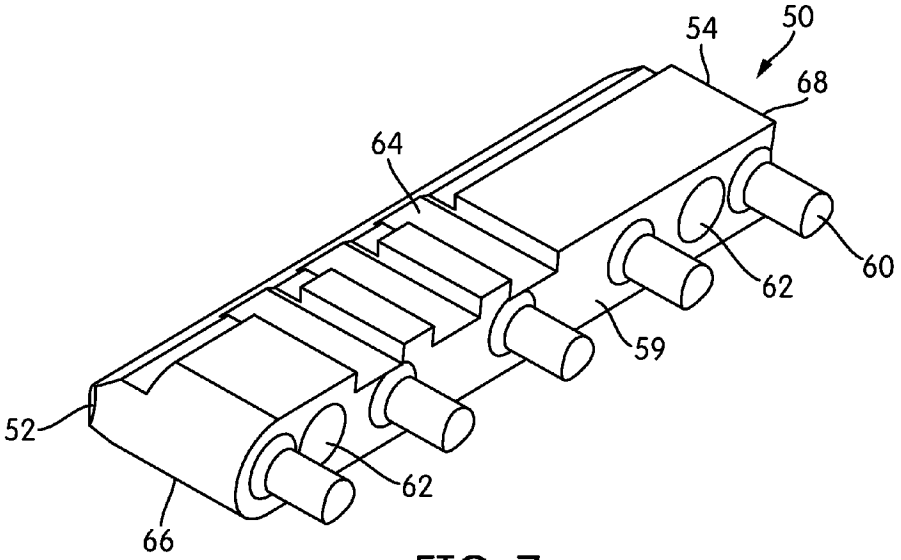
FIG. 7 is a bottom perspective view of a sidebar of the cylinder lock.
Figure 8:
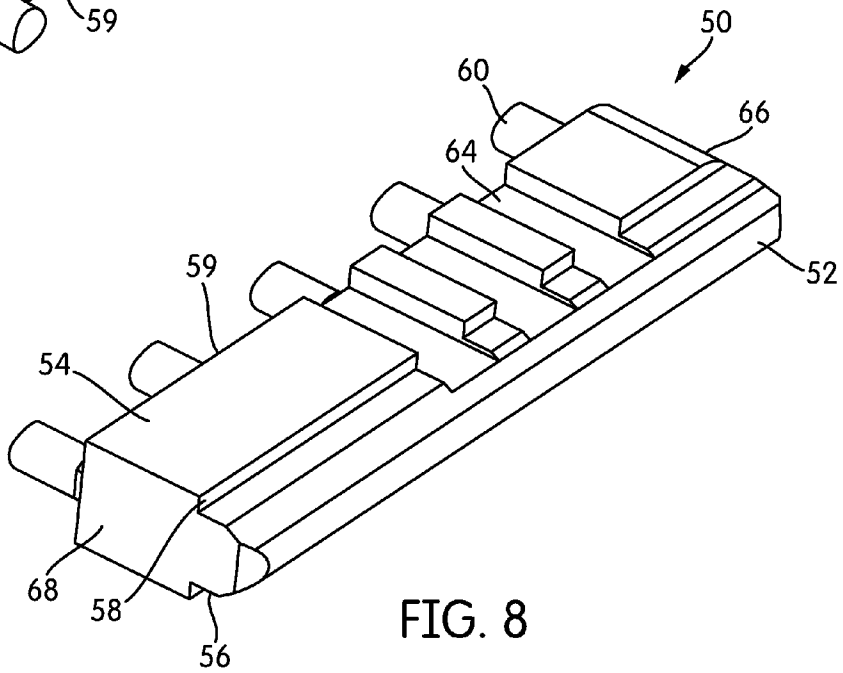
FIG. 8 is a top perspective view of the sidebar.
Figure 9:
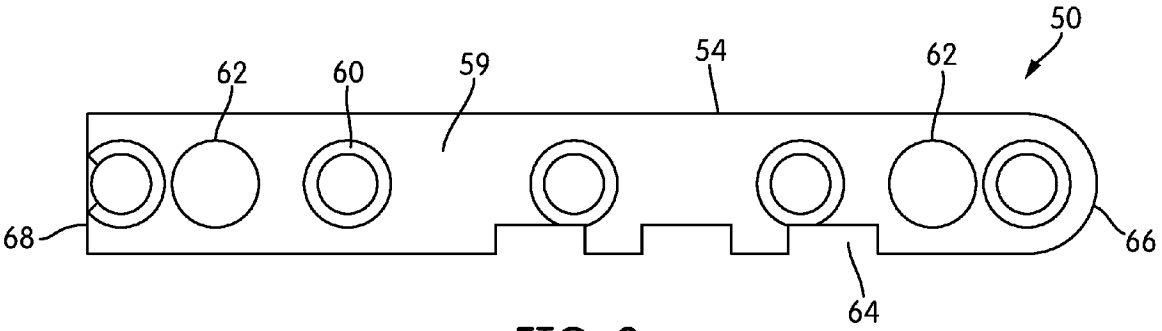
FIG. 9 is a bottom view of the sidebar.
Figure 10:
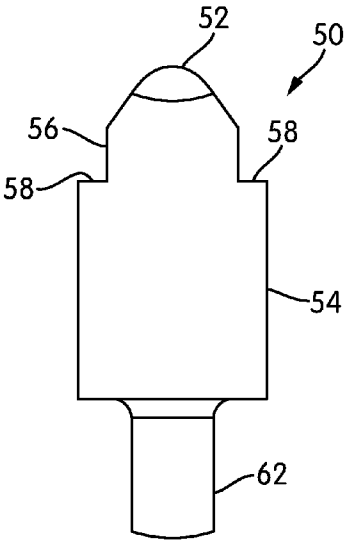
FIG. 10 is an end view of the sidebar.

Details of the keyway 16 are shown in FIGS. 5, 6, and 21.

As can be seen in FIG. 21 (as well as FIGS. 5 and 6), warding ridges 22 are disposed on sides of the keyway 16 that do not correspond to the locations of the tumbler pins 80 and tumbler pin holes 24. On the other hand, in an embodiment, at least one of the warding ridges 25 (the top ridge 25 shown in FIG. 21) is aligned with the tumbler pin holes 24. As illustrated in FIG. 21, warding ridge 25 is aligned with a portion of the tumbler hole 24, but is not directly aligned with the chiseled end 90 of the tumbler pin 80. In another embodiment, a warding ridge 25 may be aligned with at least a portion of the chiseled ends 90 of the tumbler pins 80. The warding ridge(s) 25 aligned with the tumbler pin holes 24 and/or chiseled ends 90 interferes with access to the tumbler pins 80 by a lock-picking tool. In prior art locks lacking a warding ridge that is aligned with the tumbler pin holes, there is an open space within the keyway that allows more easy access to the tumbler pins by a lock-picking tool, so that the tumbler pins can be manipulated into unlock positions with the lock-picking tool. The interference provided by warding ridge(s) 25 makes it more difficult to manipulate the tumbler pins into unlock positions with the lock-picking tool.

Details of a key or key blank 130 are shown in FIGS. 22-28.

In general, the key 130 includes a bow 132 and a generally flat-sided blade 134 extending from the bow 132. The blade 134 includes sides 136 extending between a first edge 140 and a second edge 142. One or both sides 136 of the blade 134 are divided into a bitted section 152, on which the bitting for operating the lock is formed, and a non-bitted section 156 that is devoid of any bitting. In one embodiment, each of the bitted section 152 and the non-bitted section 156 comprises half of the width of the side 136 of the blade 134.

Bitted section 152 may include one or more warding grooves 154, and the non-bitted section 156 may include one or more warding grooves 158. The warding grooves 154, 158 cooperate with the warding ridges 22, 25 of the keyway 16.

According to aspects of the disclosure, the bitting for positioning the tumbler pins is formed only on the bitted section 152 of the blade 134 and, in one embodiment, comprises a first bitting 162, a second bitting 170, and a third bitting 178. Note that the warding groove 154 in the bitted section 152 of the blade 134 extends through the bittings 162, 170, 178. This can be seen in FIG. 26, which is a transverse cross-section of the key along the line 26-26 in FIG. 25. Only three bittings are shown as an example. Typically, a lock would have a number of tumbler pins corresponding to the number of tumbler pin holes formed in the cylinder, and the key would have an equal number of bittings. Thus, lock 10 would typically have five tumbler pins—one for each of the five tumbler pin holes 24—and the key 130 would have five bittings—one for each tumbler pin.

Figure 24:
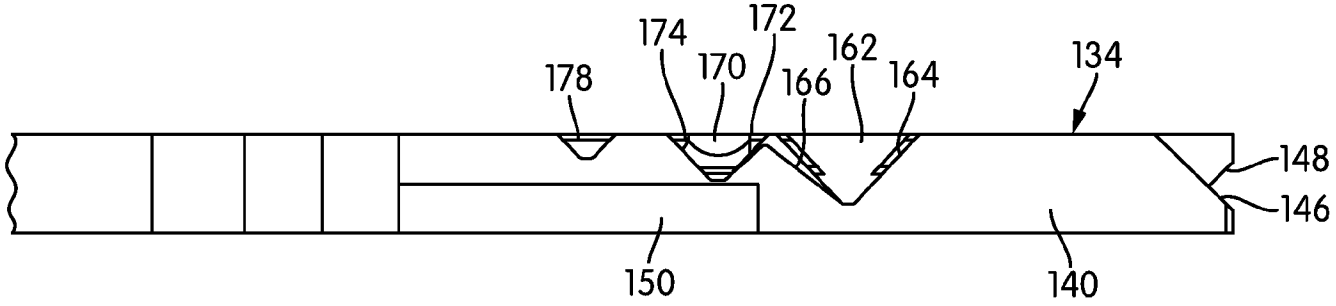
FIG. 24 is a partial edge view of the key.
Figure 28:
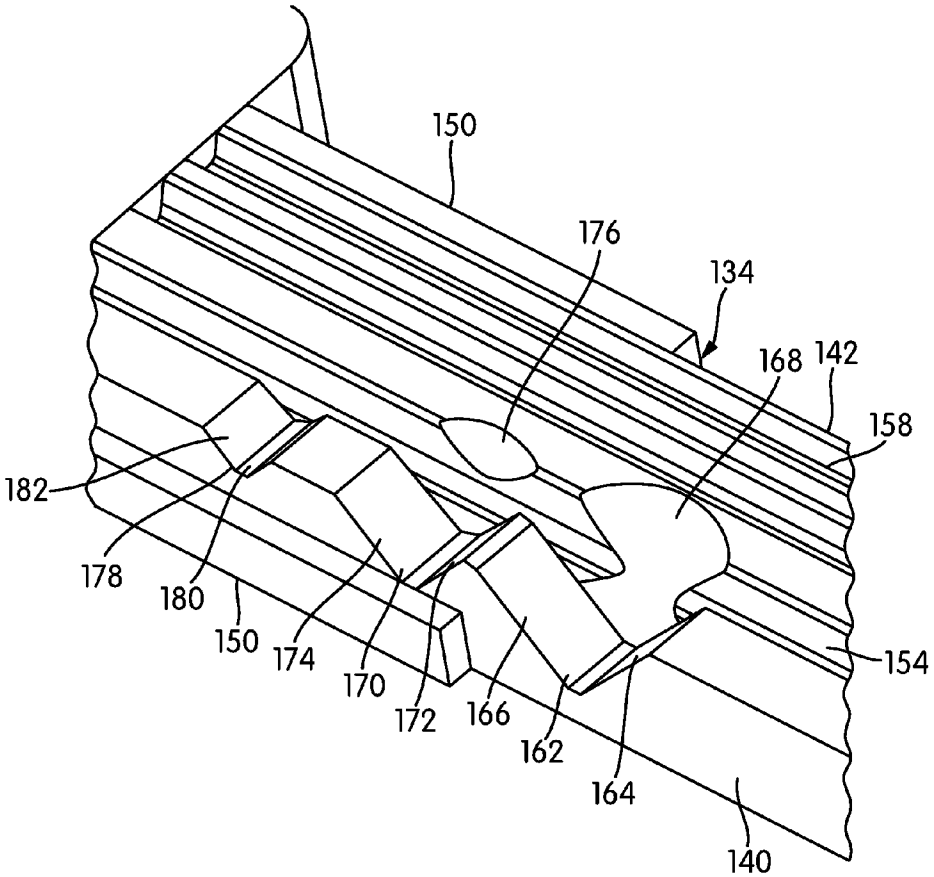
FIG. 28 is an enlarged partial perspective view of a blade of the key.

Referring to FIGS. 24 and 28, the bittings may vary in depth and width so as to provide various bitting combinations. For example, first bitting 162 is the deepest and largest bitting and includes straight angled sides 164, 166 and a curved (e.g. conical) portion 168. See also FIG. 26. The second bitting 170 includes straight angled sides 172, 174 that are not as deep as the straight angled sides 164, 166 of the first bitting 162 and a curved portion 176 that is not as deep or wide as the curved portion 168 of the first bitting 162. The third bitting 178 has only relatively shallow, straight angled sides 180, 182 and includes no curved portion. See also FIG. 23.

Each bitting 162, 170, 178 extends to the edge 140 of the blade 134. Because each bitting extends to an edge of the blade, the pins seated in the bitting can extend to and even beyond the edge of the blade. In one embodiment, the pairs of angled sides 164/166, 172/174, and 180/182 of the bittings 162, 170, and 178, respectively, are configured to have the same angles. The bittings 162, 170, 178 on the blade 134 may be formed with a pointed or formed milling cutter. The cutter is plunged in a direction normal to the side 136 into the blade 134 at the center line of the tumbler pin to the specified operating depth. The angle of the cutter tip forms the conical portion 168 of the bitting. After the cutter reaches the operating depth, it is moved sideways off the blade 134 through the edge 140 of the blade 134

Figure 29:
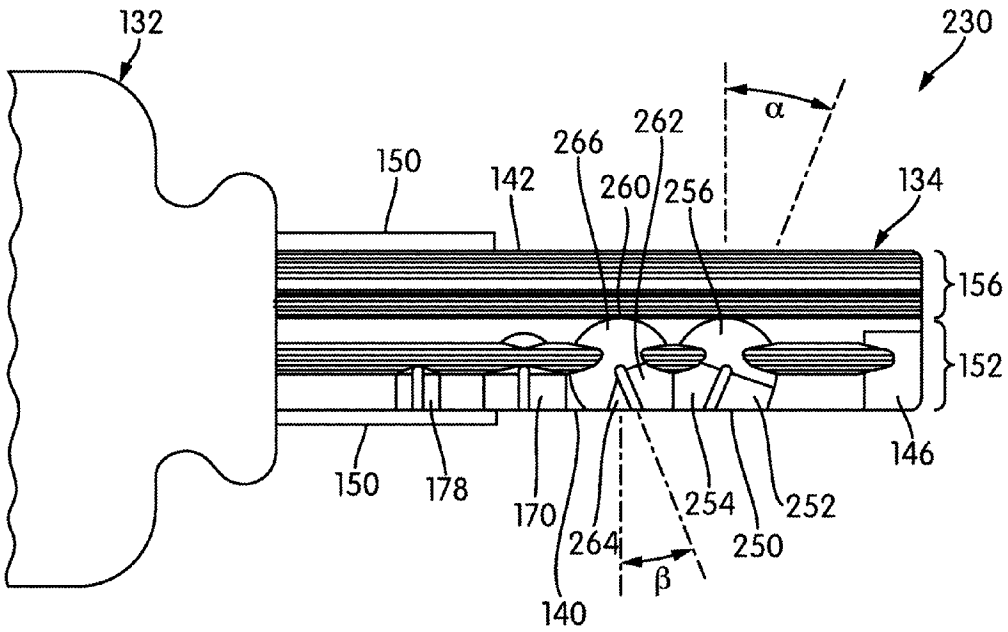
FIG. 29 is a partial plan view of an alternative embodiment of the key showing a side of the key blade

One or more of the bittings may be formed so as to be perpendicular to the longitudinal axis of the blade 134, for example, by moving the cutter straight through the edge 140 of the blade 134. Alternatively, one or more bittings may be formed at an angle relative to a line perpendicular to the longitudinal axis of the blade 134 corresponding to the rotation needed to correctly position the tumbler pin. Such an angled bitting may be formed, for example, by moving the cutter at an angle through the edge 140 of the blade 134. Such angled bittings are shown in key 230 in FIG. 29. In many respects, key 230 is similar or identical to key 130, and thus keys 230 and 130 share many common reference numbers. Key 230 differs from key 130, however, in that key 230 includes bittings 250 and 260, that are formed at an angle relative to a line perpendicular to the longitudinal axis of the blade 134. For example, bitting 250 includes straight angled sides 252 and 254 and a conical portion 256 and is formed at an angle $\alpha$ relative to a line perpendicular to the longitudinal axis of the blade 134. Bitting 260 includes straight angled sides 262 and 264 and a conical portion 266 and is formed at an angle $\beta$ relative to a line perpendicular to the longitudinal axis of the blade 134.

Accordingly, other than at the conical portion, the depth of each bitting 162, 170, 178 (250, 260) is uniform to the edge of the blade 134. See FIG. 26. This is contrary to prior art bittings formed on the sides of key blades, where the bitting depth was not constant and was curved due to the curvature of the circular cutting tool used to form the bitting in the blade.

In a reversible key embodiment, bittings are formed on both sides of the key blade 134 so that the key can be inserted into the keyway in either orientation. The bitting may be the same on both sides 136 of the blade 134 so that the same lock can be operated by inserting the key in either orientation. Alternatively, the bitting may be different on opposite sides of the blade so that the key can be inserted in one orientation to open one lock and in the opposite orientation to open a different lock.

Figure 25:
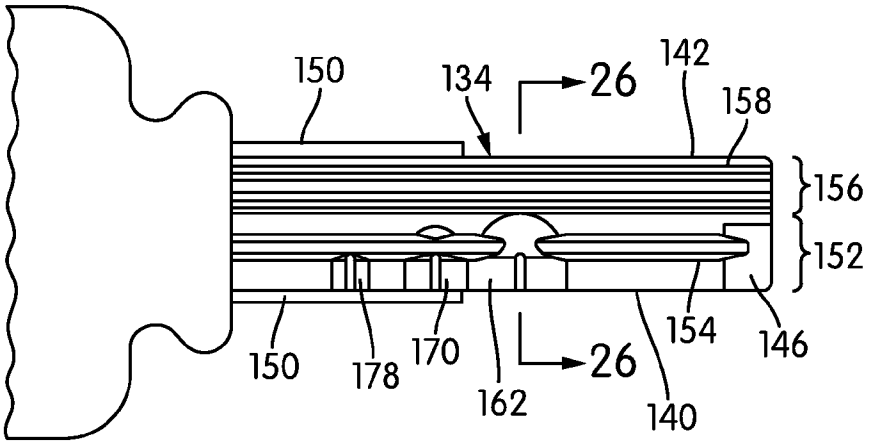
FIG. 25 is a partial plan view of the key showing a side of the key blade.
Figure 26:
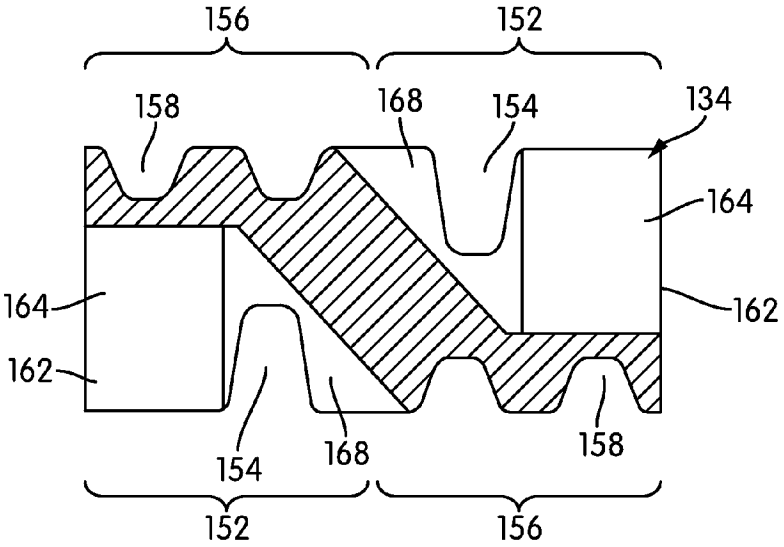
FIG. 26 is a transverse cross-section of the key along the line 26-26 in FIG. 25.

As shown in FIG. 26, which is a transverse cross-section along the line 26-26 in FIG. 25, each bitting (FIG. 26 shows the first bitting 162) can be formed on opposite sides of the blade 134 so that the blade will be reversible and the bittings will be in the same position and orientation regardless of the orientation of the blade 134. Each side has a bitted section 152 and a non-bitted section 156.

In other embodiments, however, the key is not operatively reversible and may have bittings formed on only one side 136 of the blade 134.

Figure 27:
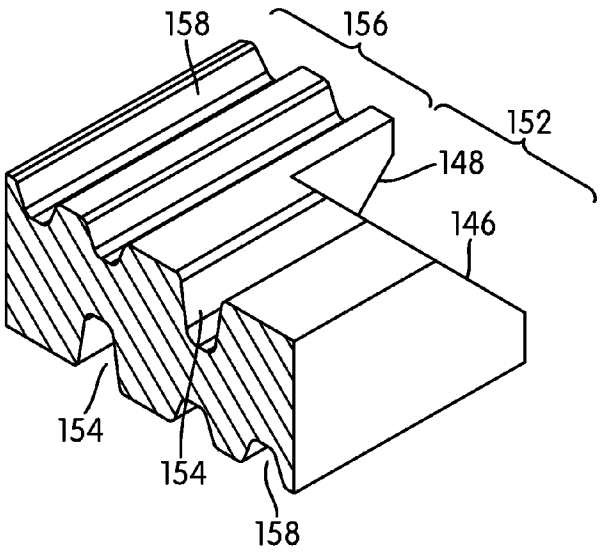
FIG. 27 is a transverse cross-sectional view of the key along the line 27-27 in FIG. 22.

The key blade 134 may be provided with distal end beveling to facilitate insertion of the key into the keyway. In a reversible embodiment, as shown in FIG. 27, the key blade 134 includes distal end bevel 146 on one half of the key blade and distal end bevel 148 on the other half of the key blade, whereby the bevels are oriented at opposite angles.

In one embodiment, the key 130 further includes slider bitting, which may comprise one or two slider contacts 150 disposed along and extending from the first edge 140 and/or the second edge 142 of the blade 134. In the illustrated embodiment, each slider contact 150 comprises a ridge extending from the bow 132 for a prescribed longitudinal distance along the key blade 134 to a terminal end of the contact 150. The ridge may be rectangular in transverse cross-sectional shape, as shown, or the ridge could be rounded. When the key blade 134 is inserted into the keyway 16, the rectangular feature 23 of the keyway 16 (see FIG. 6) accommodates the slider contact 150. As the key blade 134 is advanced into the keyway 16, the terminal end of the slider contact 150 contacts the key contact lug 112 of the slider 100 and moves the slider to a non-blocking position, as will be described in more detail below.

In an alternate embodiment, the slider bitting comprises a single tab, abutment, or other feature that will contact or be contacted by the slider and that is disposed at the first edge 140 and/or the second edge 142 at a prescribed longitudinal distance along the key blade 134.

For a reversible key configured to operate the same lock regardless of the insertion orientation, a slider bitting is disposed at the same prescribed longitudinal distance along the key blade 134 on both the first edge 140 and the second edge 142. For a reversible key configured to operate different locks when inserted in one orientation or an opposite orientation, a slider bitting is disposed on both the first edge 140 and the second edge 142 and may be located at the same prescribed longitudinal distance along the key blade or different prescribed longitudinal distances along the key blade 134.

Details of the assembly and the operation of the lock 10 and associated key 130 are shown in FIGS. 18-21.

When the lock 10 is in a locked condition, and before key 130 is inserted therein, the tumbler pins 80, each disposed within an associated tumbler pinhole 24 of the plug 12, are biased downwardly into the keyway 16 by springs (not shown). The sidebar 50 positioned within the sidebar cavity 32 formed in the plug 12 is biased radially outwardly into its first position so that the nose 52 extends into a longitudinal sidebar slot 204 formed in the bore 202 of the housing 200 within which the plug 12 is disposed. The pins 60 of the sidebar 50 may extend into the corresponding sidebar pin holes 36, but, the tumbler pins 80 are axially and rotationally positioned within each tumbler hole 24 so that the sidebar hole 92 of each tumbler pin 80 is not aligned with a corresponding pin 60 of the sidebar 50. The slider 100 is disposed within the slider cavity 40 formed in the plug 12, and the sidebar lugs 110 extend into the sidebar cavity 32 through the slider entrance 38. The slider 100 is initially biased forwardly (i.e. toward the head 14 of the plug 12) into its first position so that the sidebar lugs 110 are not aligned with the slider slots 64 of the sidebar 50. Thus, rotation of the plug 12 is prevented by the sidebar 50. Furthermore, movement of the sidebar 50 radially inwardly is blocked by (1) the pins 60 contacting a side of each of the corresponding tumbling pins 80, and (2) the sidebar 50 contacting the sidebar lugs 110 of the slider 100.

As the blade 134 of a properly bitted and warded key 130 is inserted into the keyway 16, the blade 134 engages and positions each of the tumbler pins 80. In this regard, the distal end bevel 146 or 148 at the end of the blade 134 facilitates the initial lifting of each tumbler pin 80 up onto a side 136 of the blade 134 as the blade 134 is advanced into the keyway 16. As the blade 134 is further advanced into the keyway, the bitting (e.g., first bitting 162) encounters the chiseled end 90 of each tumbler pin 80, thereby elevating and rotating the corresponding tumbler pin 80. Proper elevation of the tumbler pin 80 places the sidebar hole 92 of each tumbler pin 80 at the elevation corresponding to the position of each pin 60 extending into the tumbler hole 24 through the corresponding sidebar pin hole 36. Rotation of the tumbler pin 80 by the bitting 162 engaging the chiseled end 90 completes the alignment of the sidebar hole 92 with the pin 60 and the sidebar pin hole 36.

In addition, the slider contact 150 of the blade 134 contacts the key contact lug 112 of the slider 100 extending into the keyway 16 through the keyway opening 46. The length of the slider contact 150 is such that insertion of the blade 134 pushes the slider 100 to an axial position (i.e., its second position) to align the sidebar lugs 110 of the slider 100 with the slider slots 64 formed in the sidebar 50. In this regard, the positions of the sidebar lugs 110 and the slider slots 64 and the length of the slider contact 150 can be uniquely configured to provide unique keying. Thus, with the sidebar hole 92 of each tumbler pin 80 aligned with its corresponding pin 60 of the sidebar 50 and with the sidebar lugs 110 of the slider 100 aligned with the slider slot 64 of the sidebar 50, the sidebar is no longer blocked from movement in a radially inward direction. The nose 52 engaged with the sidebar groove 204 will act as a cam as torque is applied to the plug 12 thereby causing the nose 52 to be forced out of the sidebar groove 204, which is enabled since the sidebar 50 is not blocked from moving radially inwardly. Accordingly, application of a torque to the plug 12 causes the sidebar 50 to move radially inwardly toward its second position due to the shaping of the sidebar nose 52 and the sidebar groove 204 within which it is disposed. Therefore, the sidebar nose 52 can be moved out of the sidebar slot 204, and the plug 12 is now able to rotate within the bore 202 relative to the housing 200.

While the subject matter disclosed herein has been described and shown in considerable detail with reference to certain illustrative embodiments, including various combinations and sub-combinations of features, those skilled in the art will readily appreciate other embodiments and variations and modifications thereof as encompassed within the scope of the disclosed subject matter. Moreover, the descriptions of such embodiments, combinations, and sub-combinations is not intended to convey that the subject matter disclosed herein requires features or combinations of features other than those expressly recited in the claims. Accordingly, the disclosed subject matter is deemed to include all modifications and variations encompassed within the spirit and scope of the following appended claims.

The invention claimed is:

1. A lock comprising:

a cylinder having a keyway extending in an axial direction and one or more tumbler holes formed therein and extending in radial directions to the keyway;

one or more tumbler pins, each disposed in a corresponding one of the tumbler holes;

a sidebar disposed in a sidebar cavity formed in the cylinder and moveable within the sidebar cavity in a radial direction between a first position and a second position, wherein in the first position, the sidebar extends outwardly from the sidebar cavity to engage a sidebar groove formed in a housing within which the cylinder is rotationally disposed so as to prevent the cylinder from rotating with respect to the housing, and in the second position, the sidebar is retracted into the sidebar cavity to disengage from the sidebar groove and permit the cylinder to rotate with respect to the housing;

wherein each tumbler pin is configured to be moveable in a radial direction between a first position blocking movement of the sidebar from its first position to its second position and a second position permitting movement of the sidebar from its first position to its second position, and a slider disposed in a slider cavity formed in the cylinder and moveable within the slider cavity in an axial direction between a first position and a second position, wherein in the first position, the slider blocks movement of the sidebar from its first position to its second position, and in the second position, the slider does not block movement of the sidebar from its first position to its second position, wherein the keyway is configured and oriented with respect to the one or more tumbler pins and each corresponding tumbler hole so that the width of the keyway is generally perpendicular to the axes of the tumbler holes so that a key having bitting formed on a side thereof will engage each tumbler pin positioned within each corresponding tumbler hole to move each tumbler pin from its first position to its second position, and wherein a portion of the slider extends into the keyway so as to be engaged by a key inserted into the keyway to move the slider from its first position to its second position.

2. The lock according to claim 1, further comprising:

an axial channel extending along each tumbler hole; and a lug extending from each tumbler pin and being disposed in the axial channel of the corresponding tumbler hole, wherein the width of the axial channel is larger than the width of the lug, so that the pin may rotate partially about its longitudinal axis within the tumbler hole until the lug contacts a side of the axial channel.

3. The lock according to claim 1, wherein the sidebar includes sidebar pins aligned with sidebar pin holes extending through a wall forming an end of the sidebar cavity and into a corresponding one of the tumbler holes, and wherein each tumbler pin includes a sidebar hole formed therein and configured so that: (1) when each tumbler pin is in its first position, the sidebar hole formed in the tumbler pin is not aligned with the sidebar pin hole so that a corresponding sidebar pin extending through the sidebar pin hole contacts the tumbler pin to block the sidebar from moving from its first position to its second position, and (2) when each tumbler pin is in its second position, the sidebar hole formed in the tumbler pin is aligned with the sidebar pin hole so that the corresponding sidebar pin extending through the sidebar pin hole extends into the sidebar hole of the tumbler pin to allow the sidebar to move from its first position to its second position.

4. The lock according to claim 1, wherein the sidebar includes slider slots formed therein, and wherein the slider includes sidebar lugs extending into the sidebar cavity and configured so that: (1) when the slider is in its first position, the sidebar lugs are not aligned with the slider slots so that the sidebar contacts the sidebar lugs to block the sidebar from moving from its first position to its second position, and (2) when the slider is in its second position, the sidebar lugs are aligned with the slider slots to allow the sidebar to move from its first position to its second position.

5. The lock according to claim 1, wherein each tumbler pin includes a chiseled end configured to be engaged by the key to elevate the tumbler pin from its first position to its second position.

6. The lock according to claim 1, wherein each tumbler pin includes a chiseled end configured to be engaged by the key to elevate and rotate the tumbler pin from its first position to its second position.

7. The lock according to claim 1, wherein each tumbler pin includes a cut-out at a key-engaging portion of the tumbler pin so that the tumbler pin engages only a portion of the key.

8. The lock according to claim 1, wherein the portion of the slider that extends into the keyway comprises a key contact lug extending into the keyway and configured to be contacted by a portion of a key inserted into the keyway to move the slider.

9. The lock according to claim 1, wherein the slider cavity extends into the cylinder at an orientation that is generally perpendicular to the orientation of the sidebar cavity.

10. The lock according to claim 1, wherein the keyway includes a warding ridge that is aligned with the one or more tumbler holes.

* * * * *